US006176400B1

(12) United States Patent
Lam

(10) Patent No.: US 6,176,400 B1
(45) Date of Patent: Jan. 23, 2001

(54) GARMENT SUPPORTING STAND

(76) Inventor: Peter Ar-Fu Lam, 20104 Wayne Ave., Torrance, CA (US) 90503

( * ) Notice: Under 35 U.S.C. 154(b), the term of this patent shall be extended for 0 days.

(21) Appl. No.: 09/250,668

(22) Filed: Feb. 16, 1999

(51) Int. Cl.[7] ..... A41M 5/00
(52) U.S. Cl. ..... 223/120
(58) Field of Search ..... 223/120, 89, 94, 223/85; 248/121, 122.1, 124.1

(56) References Cited

U.S. PATENT DOCUMENTS

D. 166,658 * 5/1952 Cohen ..... D33/8
D. 174,739 * 5/1955 Crockett, Jr. ..... D33/8
863,820 * 8/1907 Wingert ..... 223/120
4,792,071 * 12/1988 Scarpa et al. ..... 223/120
5,121,890 * 6/1992 Komada ..... 248/122
5,664,710 * 9/1997 Lam ..... 223/89

* cited by examiner

*Primary Examiner*—Bibhu Mohanty

(57) ABSTRACT

An adjustable garment supporting apparatus (10) is disclosed having extension members (16, 16*a*) which move laterally from a medial portion (29). The extension members move as a result of engagement between a pair of tongues (13, 13*a*) and medially disposed pinion (11). Disclosed embodiments include supporting frame 28 which conveniently maintains the adjustable garment, supporting assembly at a desirable level above the floor surface. Embodiments also include mounting means to mount the adjustable garment supporting assembly onto a panel.

22 Claims, 3 Drawing Sheets

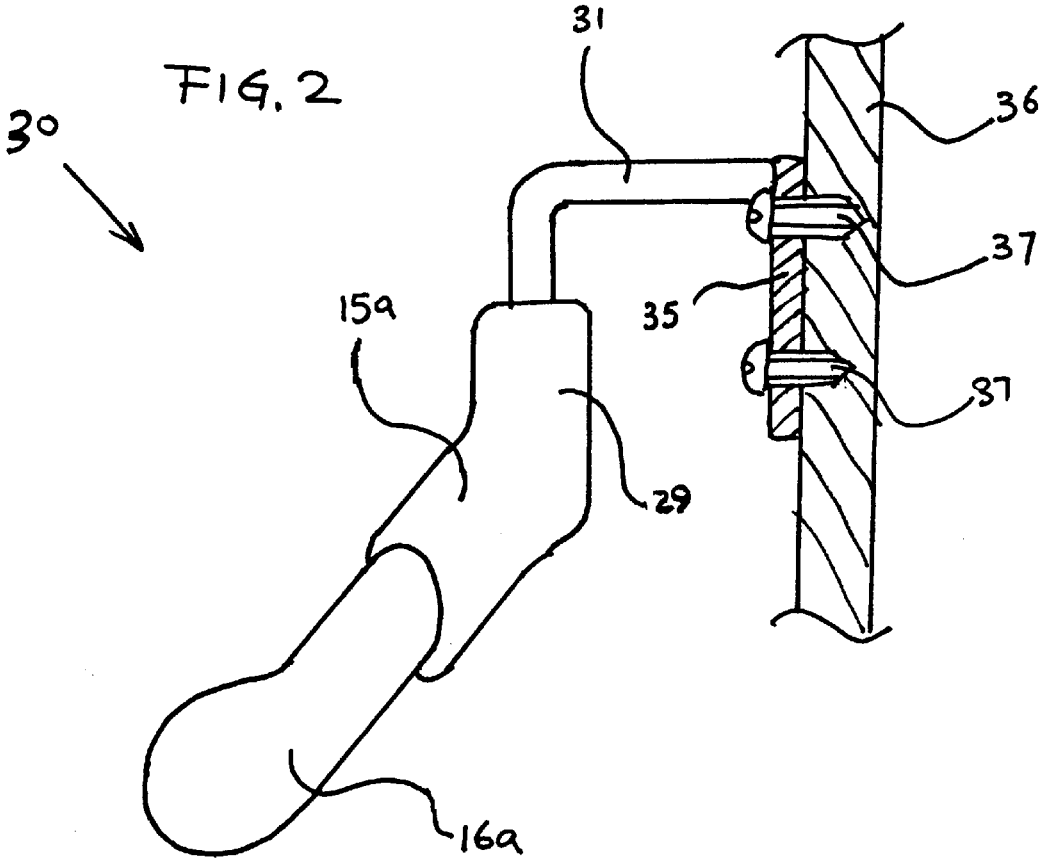
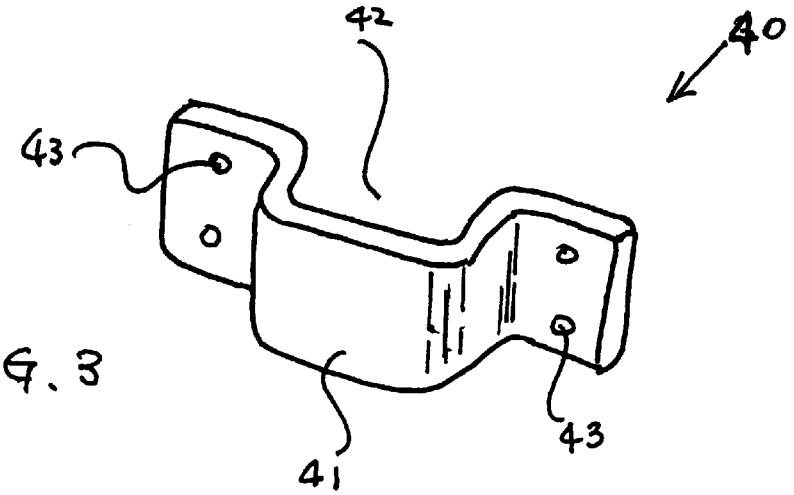
FIG. 3

GARMENT SUPPORTING STAND

FIELD OF THE INVENTION

The present invention relates to an apparatus configured to support garment at a convenient level above the floor.

BACKGROUND OF INVENTION

Garments are optimally maintained on hangers sized appropriately to the garment. Unsuitable sized hangers will result in distortion at the shoulder portion of the garment especially to the expensive knit wear and leather jackets. The correction result can be achieved either by using differently sized fixed width hangers or by using adjustable width hangers.

Hotel guests are of a wide range of body sizes. It is impossible for hotel operators to predict the body size of the hotel guests and to supply suitable fix sized hangers. Therefore the adjustable size hanger is a necessity for hotel operators to appropriately service the hotel guests and protect their valued fashion and overcoat. It is also convenient for the hotel guests if each hotel room is equipped with an adjustable width garment hanger mounted on a floor stand. In addition to the convenience, the bulky size of a floor stand integrated with an adjustable hanger will prevent an innovative adjustable garment hanger to be removed from the room by the customers. Alternatively, a securely wall mounted adjustable garment hanger will also achieve the same service enhancement and security effects.

The prior art is replete with various configurations of garment hangers which incorporate structure for selectively adjusting the hanger's width to accommodate different size garments. Applicant's issued U.S. Pat. Nos. 5,102,019, 5,511,701 and 5,664,710 disclose some such structures as do certain ones of the references U.S. Pat. Nos. 3,024,954, 5,044,535, 2,477,873, European patents DE-C-286 192, WO-A-94 02056, DE-U-88 04 572 and DE-A-40 07 320 cited therein.

SUMMARY OF THE INVENTION

The present invention is directed to an adjustable garment hanger integrally mounted on a floor stand or securely mounted onto a panel. The garment hanger is incorporated with improved reciprocal adjustment mechanism for adjusting the hanger's width. An improved reciprocal transfer mechanism perfectly tracks the movement of both extension members and maintain the exact symmetry of the garment hanger.

According to one aspect of the present invention there is provided an adjustable garment hanger having first and second elongated support arms, a transfer mechanism; and first and second extension members mounted respectively for translation along the first and second support arms. The first and second support arms are supported relative to one another at an obtuse angle therebetween; and in that each of the extension members couples to the transfer mechanism for reciprocal translation of the extension members along their respective support arms.

In one preferred embodiment of an adjustable garment hanger in accordance with the present invention when force is applied on the first extension member in the direction along the axis of the respective first support arm, the force is translated to the second extension member for reciprocal motion of the second extension member along the second support arm.

In another preferred embodiment the transfer mechanism is at least one wheel and in that each of the extension members includes a tongue coupled to the wheel for reciprocal translation of the extension members along their respective support arms.

In a further preferred embodiment means are provided for guiding each of the tongues along a path that is tangent with the wheel for engagement thereof. Conveniently, each of the paths includes a first segment substantially aligned with one of the support arms and a second segment substantially aligned with the other of the support arms. Moreover, the tongue of each extension member is preferably a flexible tongue.

In another preferred embodiment the transfer mechanism composed a driving means such as a turning knob. The turning knob is coupled to the wheel to facilitate manual turning thereof for translation of the extension members. When the knob is turned, the driving power is distributed into two paths, each directs the adjustment of an extension member. In many preferred embodiments, the reciprocal adjusting characteristics and the distribution of turning power to both extension members can be achieved at the same time. Conveniently, a motor is included in the transfer mechanism to deliver the driving power.

In a further embodiment there are provided at least first and second wheels mounted approximate to the medial portion between the support arms for rotation; the first extension member being coupled to the first wheel; said second extension member being coupled to the second wheel; and the first wheel coupled to the second wheel for reciprocal translation of the extension members along their support arms.

In yet a further embodiment a transfer mechanism preferably comprising at least a first wheel mounted approximal to the medial portion for rotation; each of the extension members having an inner end and an outer end, the movement paths of the inner end of the extension members cross over each other side by side at a location proximal to the top of the medial portion; and the inner ends of each extension member is coupled to the transfer mechanism for reciprocal translation of the extension members along their support arms. Conveniently, there are provided two wheels mounted for rotation on spaced apart axes and with peripheral coupling therebetween; and a substantially non-flexible tongue extending from each of the first and second extension members to contact a respective one of the wheels, the tongues being arranged to cross-over in the medial portion when the extension members are at their innermost position on the support arms. In this design room is required on top of the transfer mechanism to accommodate the terminal ends of the tongues. Advantageously, in any of the embodiments the wheels or the first wheel includes a plurality of peripherally defined teeth and each inner end of the extension members defines a plurality of teeth. Although the tongues of each extension members is preferably to be of a rigid structure for this embodiment, it can also comprise a flexible region.

The reciprocal adjustment assembly is then mounted onto a supporting structure such as a frame, which stands on the floor. The assembly is preferably to be permanently mounted, such as by bonding or by screws in order that the hanger assembly and the stand assembly not to be easily separated.

Alternatively the adjustable hanger assembly is configured to be mounted against a panel such as the wall inside a closet, a wall inside a hotel room or behind a door.

The combination of the reciprocal adjustment assembly with a supporting structure such as a floor stand or panel is very important for hotel operators. Firstly it provides dimension perfect to the valuable clothing of the hotel guests of different body sizes. Secondly, it provides a much better usage convenience to the hotel guest which is incomparable by a regular hanger positioned inside a closet. Thirdly, with a proper supporting structure, the adjustable hanger assembly is consistently positioned at convenient height level above the floor which better service the hotel guests when they return to their rooms. Fourthly, the location of the supporting structure is usually selected to be positioned at a convenience location, such as close to the hotel room entrance area or just outside a bath room door, while all regular hangers are located inside a closet. Fifthly, this combination will be very effective to resolve an unexpected problem for hotels willing to pay the premium for any innovative adjustable hangers to better service their customers. The problem was that many hotel guests took away the innovative adjustable hangers from the rooms when they check out. This problem is much less serious when only regular hangers are used. The securely wall mounted design or relative bulky floor stand mount design makes the innovative adjustable hanger impossible to be removed when the guests check out.

Another important part of the invention is to provide a mounting mechanism for the hanger assembly to achieve the intended hotel usage application. The mounting mechanism is configured to mate with one or more brackets mounted on a wall in a vertical pattern. This arrangement permits the hanger assembly to be fitted at a different level above the ground surface, according to the wish of the user.

According to another aspect of the present invention there is provided a method of forming an adjustable garment hanger, comprising the steps of arranging first and second elongate support arms to define an obtuse angle therebetween; rotatably mounting at least one wheel in operative association with the arms; mounting first and second extension members on the first and second arms respectively for translation therealong; and providing a tongue on each of the extension members respectively to engage the translation means for reciprocal translation of the extension members along their respective support arms.

BRIEF DESCRIPTION OF DRAWINGS

FIG. 2 is a side view of an embodiment mounted onto a panel;

FIG. 3 is a mating receiver bracket to be mounted onto a panel or the floor stand;

DESCRIPTION OF THE PREFERRED EMBODIMENTS

Figure 1:
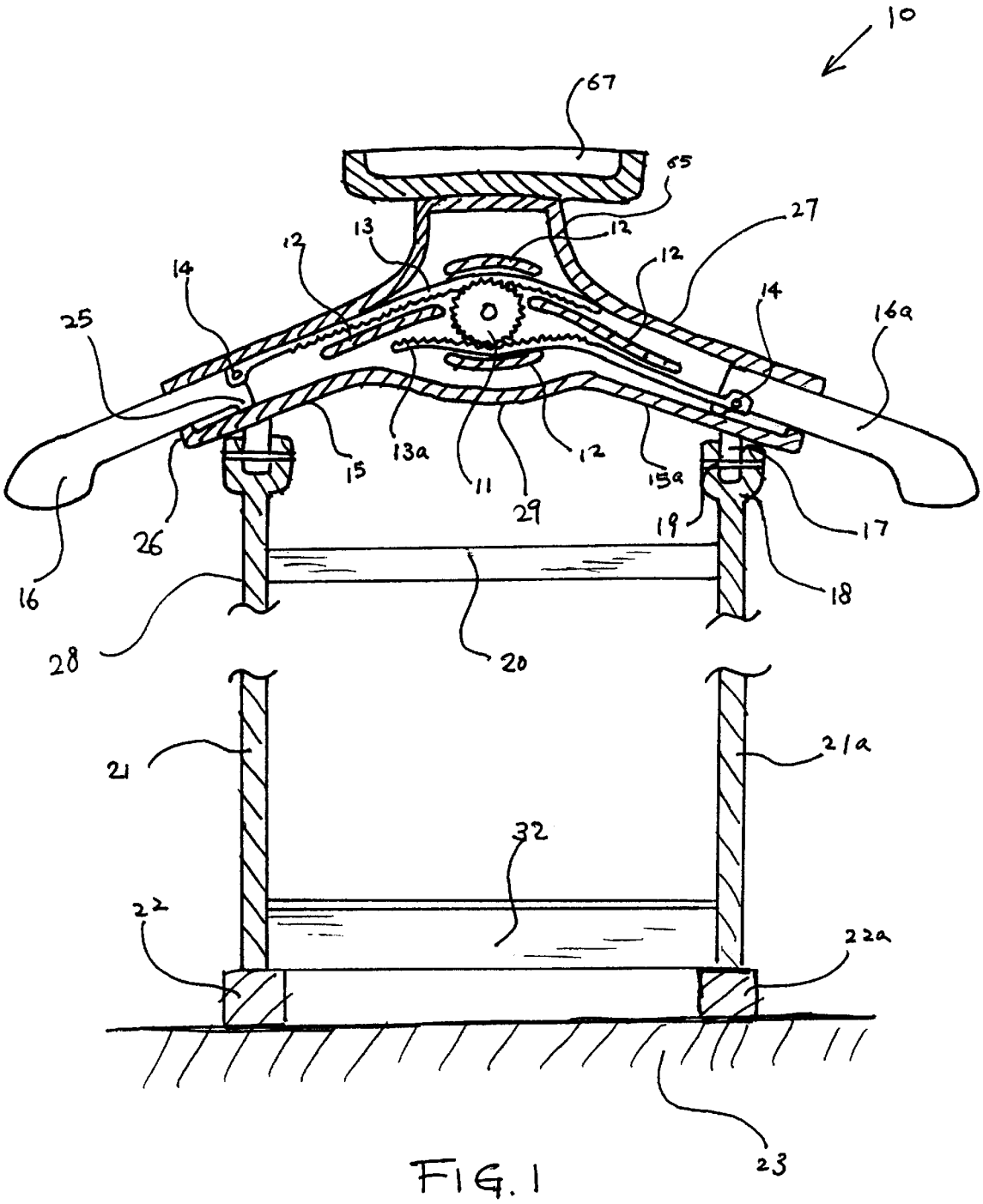
FIG. 1 is an elevation view of an adjustable garment supporting apparatus showing a preferred embodiment in accordance with the present invention; the reciprocal adjustable hanger assembly is mounted onto a floor stand.

FIG. 1 is an elevation view illustrating a preferred adjustable hanger embodiment 10 in accordance with the present invention. The garment supporting apparatus includes an adjustable garment supporting assembly 27 mounted onto a floor standing frame 28. The adjustable garment supporting assembly have a pair of elongate support members in the form of arms 15, 15*a*. The terminal ends of the arms 15, 15*a* are arranged to define an obtuse angle from the center point of the transfer mechanism and respectively carry slidable extension members 16, 16*a*. The extension members respectively have flexible racks 13, 13*a* extending therefrom which are guided to engage a pinion gear 11 rotatably mounted at a medial portion 29 of the adjustable hanger assembly 27. The flexibility of the racks 13, 13*a* allow each of them to follow a respective guide path that is tangent to the pinion and which includes path segments substantially parallel to each of the arms 15, 15*a*. It should be noted that the gear 11 can be replaced with a friction wheel as an alternative design option. The engagement with the wheel, that is the friction wheel or gear 11 with the tongues or racks 13 directs the movement of an extension member when the other extension member is moved. The outside ends of the extension members 16, 16*a* are contoured to suitably supporting the shoulder portions of a garment.

Thus, each extension member 16, 16*a* can be reciprocally translated along its respective arm. Movement of the extension members 16, 16*a* can be accomplished by grasping each in one hand and urging them inward or outward. Alternatively, the frame can be grasped in one hand and either of the extension members urged inward or outward with the other hand. Engagement of each flexible rack 13, 13*a* with the pinion 11 insures that any change in the spacing of one extension member from the frame medial portion 29 is accompanied by an equal change in the spacing of the other extension member, i.e., the extension members 16, 16*a* are reciprocally and oppositely translated on their respective arms 15, 15*a*.

An alternative mode of operation is possible by engaging a turning knob with the gear 11. Turning force applied to the turning knob is divided into two paths by the gear 11 to move the two extension members respectively. Another more advanced design is to engage a motor with the gear 11. Turning motion of the motor will then be translated into the adjustment motion of the two extension members 16, 16*a*.

If the extension members 16, 16*a* are urged towards the medial frame portion 29, the pinion 11 rotates in one angular direction and if they are urged away from the medial frame portion 29, the pinion 11 rotates in the opposite angular direction. Friction between the parts of the adjustable hanger assembly 27 will generally cause the extension members 16, 16*a* to remain stationary when not being adjusted. However, this can be assured with a position locking member in the form of an optional pawl that can be selectively slid into locking engagement with the pinion 11.

The obtuse angle between the arms 15, 15*a* is necessary if the garment supporting apparatus 10 is to effectively support garments, e.g., coats, shirts, dresses, whose shoulder portions (or other portions) are typically formed with an obtuse angle therebetween. The obtuse angle permits the apparatus 10 to support such garments in their natural form to enhance their appearance and extend their lifetime. For example, a hanger intended for support of coats might be configured with an obtuse angle between 110 and 150 degrees. It should be appreciated that the structural features recited above (in particular, the flexible racks and the path segments along which they are guided) enable the arrangement of the supporting arms 15, 15*a* and the extension members 16, 16*a* with the desirable obtuse angle therebetween.

The adjustable hanger assembly 27 is then securely mounted onto a supporting stand 28 to position the adjustable hanger assembly 27 at a suitable level above the floor 23. Each of the supporting arm 15, 15*a* has a stud which fits with a mating receiver 18 of the floor stand 28. A locking pin 19 is inserted so that the adjustable hanger assembly and the floor stand become a secure and inseparable integral assembly. The secure mounting is a significant difference when compared with the regular suspension hooks of the regular hangers. The secure mounting design is essential to prevent the adjustable hanger assembly to be removed by the hotel customers. The length of the supporting beams 21, 21*a* of the floor stand defines the approximate level the adjustable garment hanger assembly to be above the ground level 23. The supporting bars 20, 32 maintain a even separation between the two supporting beams 21, 21*a*. The pedestals 22 and 22*a* securely maintain the floor stand in an upright position.

On top of the adjustable hanger assembly is a neck position 65 contoured to fit the neck of the garment. On top of the neck position is a tray 67 which is convenient positioned for the hotel guests to put their small belongings such as watch and eye glasses while they are changing their cloths.

A hanger supporting stand 10 is, therefore, provided which can be quickly and easily adjusted to a lateral spacing between extension members 16, 16*a* that most effectively supports a garment and keep it above a suitable ground level, inside a hotel room. The extension members 16, 16*a* are simply urged inward or outward by hand as necessary to best fit and support the garment and they remain in the desired spacing until readjusted for another garment. The hanger can be fabricated with an obtuse angle, between the arms 15, 15*a*, that best accommodates and supports a chosen garment type, e.g., coats.

Directing attention now to a detailed side view of the preferred embodiment relative to FIG. 2 which demonstrates an alternate mounting mechanism enabling the adjustable garment hanger assembly to securely position at a predefined level above the floor. The adjustable garment assembly 30 has a supporting lever 31 which extends to a mounting bracket 35. The medial portion 29, the support arm 15*a* and the extension member 16*a* correspond to the similarly numbered components of FIG. 1.

The mounting bracket 35 which is a typical example to represent an integral mounting means, has four screw holes, two on each side enabling the screws 37 to fasten the adjustable hanger assembly onto a panel 36. The position behind a door, the wall inside a hotel room closet, the room wall or any vertical flat surface are suitable representation of the panel 36. The function of the supporting lever 31 is to keep an amble space between the adjustable hanger assembly and the wall so that the garment can be comfortably positioned in this space when it is to be supported by the hanger.

FIG. 3 illustrates an alternate independent mounting bracket 40, which can be pre-mounted onto the supporting panel. When the bracket 40 is mounted onto a panel the space 42 is suitable to receive a mating mounting lever 51 of an alternative mounting design illustrated in FIG. 4. The screw holes 43 are designed for screws to fasten the mounting bracket onto a panel. An array of the brackets may be desirable to be pre-mounted vertically, one on top of each other at different levels above the floor level. In this situation, the adjustable hanger assembly 50 is configured to be detachably mounted onto a selected bracket at a desired level above the floor. The adjustable hanger assembly 50 can be removed by pushing the assembly upward to move the mounting lever 51 away from the retainer wall 55 of the mounting bracket. A conveniently located locking means is desirable to prevent the lever 51 to be accidentally removed from the mating mounting bracket 55 when a coat is removed from the hanger. A screw may be used to lock the lever 51 and 50 together after they are assembled. This method converts a detachable mounting design into an integral mounting design.

Although the lever 51 is detachably mounted onto the mating bracket 40, it is considered to be a comparatively secure mounting design because the adjustable hanger assembly is not free to move around like the regular garment hanger with a suspension member.

Figure 4:
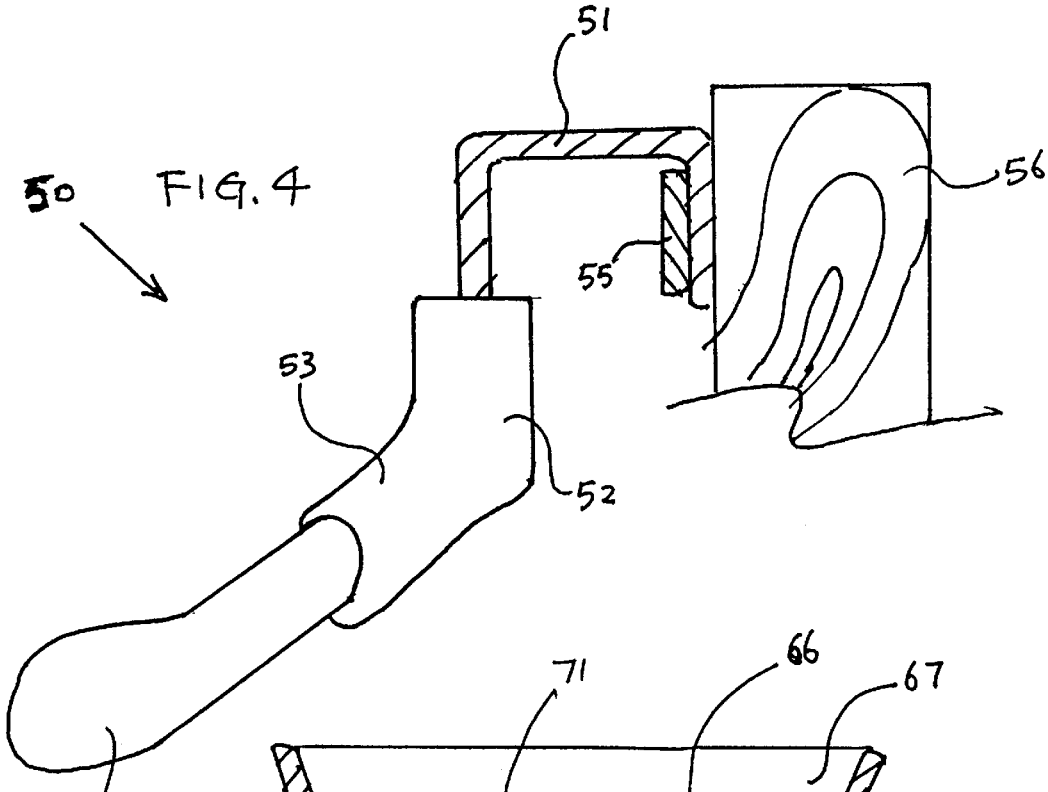
FIG. 4 is the side view of a hanger assembly mounted on to the mating bracket of FIG. 3.

It should be noted that the pair of mating mounting bracket design of FIG. 4 is not only suitable for selectively mounting the adjustable hanger assembly onto a panel at different levels above the floor, it is also applicable to be mounted to a floor stand as illustrated in FIG. 1. In this application, instead of representing a supporting panel, the vertical wood column 56 of FIG. 4 represents a part locates near the top of the floor stand.

Figure 5:
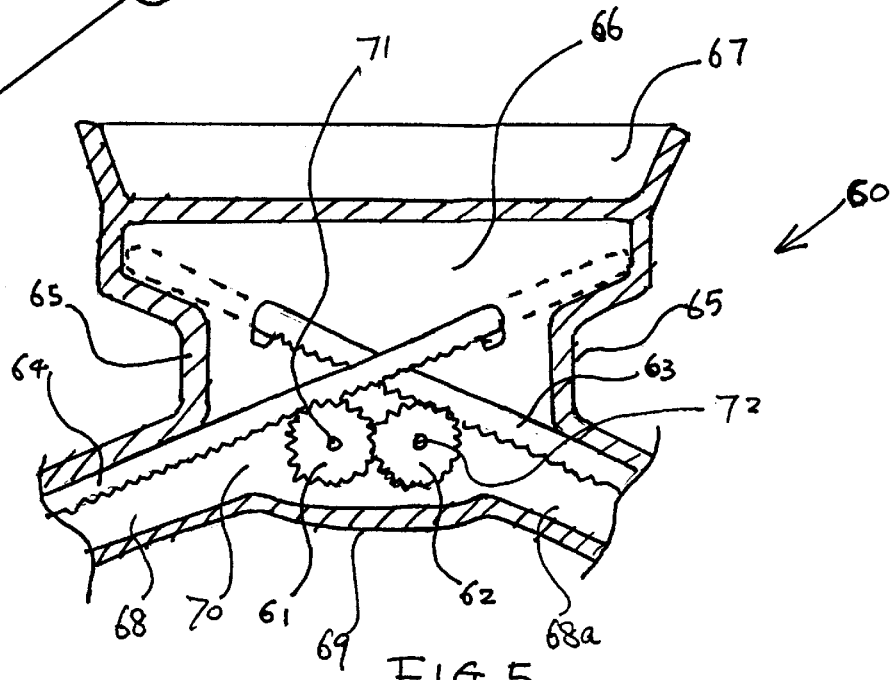
FIG. 5 is an elevation view of another embodiment having two rigid tongues coupled to a transfer mechanism comprising two gear wheels.

FIG. 5 illustrates the medial portion of an adjustable hanger assembly otherwise constructed in a manner substantially similar to the adjustable hanger assembly illustrated in FIG. 1. Accordingly, in FIG. 5 inner ends of the arms 68, 68*a* are shown extending outwardly from medial portion 69 defining a chamber 70 therein in which there are mounted wheels 61 and 62 for rotation about laterally spaced apart axes 71 and 72. Each wheel is provided with a plurality of peripheral teeth which inter engage with the teeth of the other wheel so that rotation of one wheel 61 in one direction is effective to cause wheel 62 to rotate in an opposite direction by an equal amount.

Extension members (not shown in FIG. 5) are each provided with an elongate substantially nonflexible tongue 63 and 64 respectively. Each tongue is provided with a plurality of teeth which inter engage with the teeth of a respective one of the wheels 61, 62 so that back and forth movement of either one of the tongues 63, 64 is effective to drive the other tongue in an opposite direction by an equal amount. The end of each tongue remote from its respective extension member extends beyond its respective wheel so that the tongues cross over in the medial portion chamber 70 as illustrated in FIG. 5 when the extension members are proximate to their innermost position on the support arms. As shown in FIG. 5 the remote ends of the tongues 63 and 64, respectively, are located side by side in the chamber 70. On top of the wheels 61, 62 is a room 66 which is provided to receive the tongues 63, 64. On top of the room 66 is a tray 67 for the user to put their personal belongings. The combination of a big tray 67 on top of the narrower contoured neck area 65 magically hide away the shape of the bulky room 66 required to accommodate the tongues of the extension members.

In operation the extreme outer ends of the tongues 63, 64 are in their innermost position substantially adjacent the inner wall of the room 66 which will act as a stop for the inward movement of the tongues of the extension members. If the extension member connected to tongue 64 is physically moved outwardly, wheel 61 is rotated in a counter clockwise direction and wheel 62 rotates in a clockwise direction forcing tongue 63 to move to the right in FIG. 5 by a corresponding amount until the innermost ends of the tongues 63, 64, respectively, are in the region of the area of contact the respective wheel 62, 61. Also at this time extension members 16 of FIG. 1 on arm 15 engages the end stop 26 to prevent further outward movement of the extension members and hence the tongues 63 and 64. The embodiment shown in FIG. 5 provides the advantage of rigid extension members, which are cheaper to manufacture. The symetrically structured extension members enhance the looking of the garment hanger as the tongues of both extension members are both located symmetrically on top of the transfer mechanism. The inclusion of supporting arms will be beneficial to reinforce the supporting strength of the extension members. In this situation, the support arm should provide mating guiding and locking structure to the respective extension member as described in the other relative embodiments with similar designs.

From the foregoing it should now be recognized that embodiments of an adjustable garment hanger floor stand or wall mount alternative have been disclosed herein conveniently suited for lateral adjustment to enhance the fit between a garment and its supporting apparatus for a hotel guest.

Apparatus in accordance with the present invention may be quickly adjusted to conform with each garment size and conveniently position the garment inside a hotel room and at a desirable level above the floor. Different extension members can be shaped to conform to different garments, e.g., coats, dresses. The hanger can then be modified by slidably replacing its extension members with ones directed to a different garment. It should be understood that although embodiments have been disclosed for use in hotel guest rooms, other improvement well known in the art are possible to extend the use of the invention in house hold, offices and bath rooms. It should also be understood that the secure mounting structure includes any mounting design securing the position of the adjustable hanger assembly, except the regular hook of a regular hanger.

What is claimed is:

1. An adjustable garment supporting apparatus comprising a medial portion having a transfer mechanism;

first and second elongate supporting arms each having a proximal end and a remote end extending in opposite directions from said medial portion, the remote ends of said supporting arms forms an obtuse angle from the center point of said medial portion;

first and second extension members configured for movement with respect to said support arms for adjusting the width of said garment supporting apparatus, each of the extension members further couples to said transfer mechanism for reciprocal translation of the extension members to travel in opposite directions;

mounting means to attach said apparatus to a supporting structure and prevent said apparatus to be removed from said supporting structure under normal operation.

2. The adjustable garment supporting apparatus of claim 1 wherein said supporting structure is a panel.

3. The adjustable garment supporting apparatus of claim 2 wherein said panel is a wall.

4. The adjustable garment supporting apparatus of claim 1 wherein said supporting structure is a stand.

5. The adjustable garment supporting apparatus of claim 4 wherein said stand is configured to stand on a floor.

6. The adjustable garment supporting apparatus of claim 1 wherein said mounting means comprising:

a first mounting structure securely mounted to said supporting structure and second mating mounting structure configured to securely engage said adjustable garment supporting apparatus with said first mounting structure.

7. The adjustable garment supporting apparatus of claim 6 wherein said second mating mounting structure is configured to be detachably engaged with said first mounting structure.

8. The adjustable garment supporting apparatus of claim 1 wherein said transfer mechanism comprises of one or more wheels.

9. The adjustable garment supporting apparatus of claim 1 wherein said extension members are configured to support the shoulder portions of a garment.

10. The adjustable garment supporting apparatus of claim 1 wherein each of said extension members comprises a flexible tongue for coupling to said transfer mechanism.

11. The adjustable garment supporting apparatus of claim 1 wherein each of said extension members comprises a tongue for coupling to said transfer mechanism; and the movement paths of said tongues cross over each other side by side at a location proximate to the medial portion.

12. The adjustable garment supporting apparatus of claim 1 wherein each of said extension members comprises a tongue for coupling to said transfer mechanism; and said medial portion comprises of room above said transfer mechanism to accommodate said tongues when the tongues are in the inner most position.

13. The adjustable garment supporting apparatus of claim 1 wherein said transfer mechanism comprises of adjustment means to apply adjustment force to said transfer mechanism; and force distribution means to distribute the applied force into two different paths, each path is configured for adjusting the position of each extension member.

14. The adjustable garment supporting apparatus of claim 13 wherein said adjustment means comprises a motor.

15. An adjustable garment supporting apparatus comprising a medial portion having a transfer mechanism;

first and second elongate supporting arms extending in opposite directions from said medial portion, first and second extension members configured for movement with respect to said support arms for adjusting the width of said garment supporting apparatus, each of the extension members further couples to said transfer mechanism for reciprocal translation of the extension members to travel in opposite directions; and stand supporting means configured to support the assembly of said medial portion, supporting arms and extension members.

16. The adjustable garment supporting apparatus of claim 15 wherein said stand supporting means is of vertical dimension equal or taller than 800 mm.

17. The adjustable garment supporting apparatus of claim 15 wherein said transfer mechanism comprises of at least one wheel.

18. The adjustable garment supporting apparatus of claim 15 wherein the terminal ends of said supporting arms forms an extension at an obtuse angle from each other.

19. The method to form an adjustable garment supporting apparatus comprising the steps of:

arranging first and second supporting arms to extend from a medial portion;

arranging a transfer mechanism located proximate to said medial portion;

coupling first and second extension members for movement with respect to said support arms;

couple said extension members to said transfer mechanism for reciprocal adjustable movement along said supporting arms; and arranging mounting means for securely mounting the sub-assembly of the aforementioned steps above the floor level and to prevent said sub-assembly to be removed during normal operation.

20. The method of claim 19 wherein said mounting means is represented by a stand.

21. The method of claim 19 wherein the step of arranging the mounting means comprises the procedure to mount the sub-assembly of the aforementioned steps onto a panel.

22. The method of claim 19 wherein the step of arranging a transfer mechanism includes positioning one or more wheels proximate to the medial portion.

* * * * *